US007345596B2

(12) United States Patent
Wallach et al.

(10) Patent No.: US 7,345,596 B2
(45) Date of Patent: Mar. 18, 2008

(54) SMART POLYMERIC MULTILAYER SENSORS

(75) Inventors: Morton L. Wallach, 187 Ledgewood Rd., Apt. 407, Groton, CT (US) 06340; Walter B. Lincoln, Ledvard, CT (US)

(73) Assignee: Morton L. Wallach, Groton, CT (US)

( * ) Notice: Subject to any disclaimer, the term of this patent is extended or adjusted under 35 U.S.C. 154(b) by 216 days.

(21) Appl. No.: 11/056,023

(22) Filed: Feb. 11, 2005

(65) Prior Publication Data

US 2005/0200481 A1 Sep. 15, 2005

Related U.S. Application Data

(60) Provisional application No. 60/599,141, filed on Aug. 5, 2004, provisional application No. 60/543,953, filed on Feb. 12, 2004.

(51) Int. Cl.
*G08B 23/00* (2006.01)

(52) U.S. Cl. ..... 340/984; 250/227.14; 340/603

(58) Field of Classification Search ..... 340/984, 340/691.7, 541, 665, 603, 505; 385/12; 73/170.34; 250/227.14, 227.18; 436/172; 356/402
See application file for complete search history.

(56) References Cited

U.S. PATENT DOCUMENTS

| | | | | |
|---|---|---|---|---|
| 4,812,014 A * | 3/1989 | Sawano et al. | ..... | 250/227.14 |
| 4,846,548 A * | 7/1989 | Klainer | ..... | 385/12 |
| 4,862,146 A * | 8/1989 | McCoy et al. | ..... | 340/605 |
| 5,489,536 A * | 2/1996 | Ekechukwu | ..... | 436/172 |
| 6,215,231 B1 * | 4/2001 | Newnham et al. | ..... | 310/371 |

OTHER PUBLICATIONS

"Coating Methods", Kirk-Othner, Encyclopedia of Chemical Technology, vol. 3, 4th Edition, pp. 765-833, 1993.

* cited by examiner

*Primary Examiner*—Thomas Mullen
(74) *Attorney, Agent, or Firm*—Mark Nowotarski

(57) ABSTRACT

Sensors suitable for submarine detection are in the form of multilayer polymer beads. The sensors have a change in detectible property, such as color, which occurs when said sensors are exposed to a particular stimulus such as an object or event to be detected. The change in property is thus detectible by an external monitor.

17 Claims, 2 Drawing Sheets

SMART POLYMERIC MULTILAYER SENSORS

CROSS-REFERENCE TO RELATED APPLICATION

This application claims the benefit of U.S. provisional patent application Ser. No. 60/543,953, filed Feb. 12, 2004, and entitled "Smart Polymeric Multilayer Sensors". Said provisional application Ser. No. 60/543,953, is incorporated herein by reference.

This application further claims the benefit of U.S. provisional patent application Ser. No. 60/599,141, filed Aug. 5, 2004, and entitled "Surface Swimmer Detection Via Sensors". Said provisional application Ser. No. 60/599,141, is incorporated herein by reference.

This application further incorporates by reference U.S. provisional patent application Ser. No. 60/455,142, filed Mar. 17, 2003, and entitled "Smart Polymeric Multilayer Sensors".

FIELD OF INVENTION

This invention is in the field of polymeric sensors for detection and tracking.

BACKGROUND

An improved low cost method of detecting submarines is needed.

SUMMARY OF THE INVENTION

The Summary of the Invention is provided as a guide to understanding the invention. It does not necessarily describe the most generic embodiment of the invention or all species of the invention disclosed herein.

The present invention comprises sensors that are in the form of multilayer polymer micro beads or other shapes and are about nanometers to millimeters in diameter. Said multilayer beads have a change in detectible property, such as color, density, buoyancy, or acoustic reflectivity, which occurs when exposed to a particular triggering stimulus. The change in said property is detectible by an external monitor.

DETAILED DESCRIPTION OF INVENTION

The following detailed description discloses various embodiments and features of the invention. These embodiments and features are meant to be exemplary and not limiting.

The present invention comprises sensors that are in the form of multilayer beads.

Figure 1:
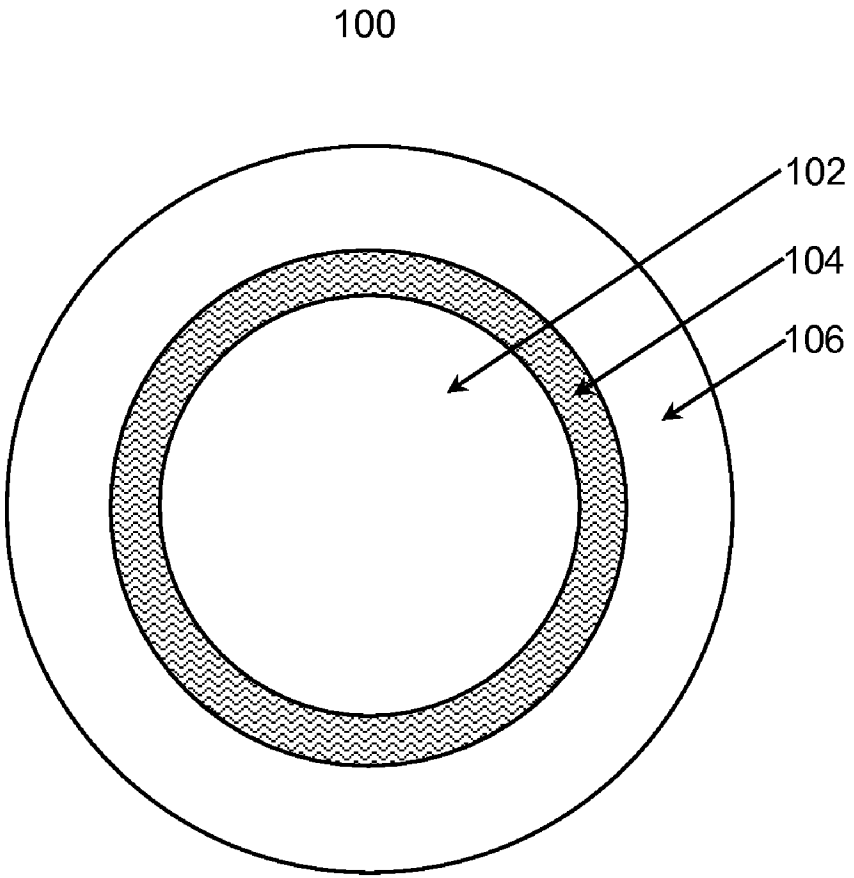
FIG. 1 is a cross section of a typical three-layer sensor bead.

FIG. 1 illustrates the cross section of a typical sensor structure. Sensor 100 is generally spherical in shape. The sensor comprises a core 102, intermediate layer 104 and outer layer 106.

Sensors may have an overall diameter in the range of a few nanometers to a few millimeters.

Sensors may also have nonspherical shapes, such as fabric swatches. Sensors may also be adhered to base film sheets.

Sensors may be distributed in large numbers in a given medium, such as air or water. When an object or chemical or physical effect disturbs said sensors, said sensors react and become detectible by a monitor. Hence the presence of said object, chemical or other physical effect may be detected.

Sensors are typically made from polymers. Suitable polymers depend upon the application. Suitable polymers include consumer, specialty, engineering, or high performance resins. Examples of suitable polymers include polyethylene, polypropylene, acrylics, vinyls, polyphenylene ether, and polyphenylene sulfide.

Biodegradable polymers such as poly(lactic acid) and aliphatic polyesters may also be used. Biodegradable polymers may be used so that sensors do not foul an ecosystem. Biodegradability can be from days to months depending on the microbe content of the medium that said sensors are distributed in.

Sensors may comprise metals. Said metals can be Fe, Cd, Se, Al, or Cu, mixtures thereof or other metals depending on the application. Metals can be employed as alloys, compounds, or in layered combination with polymers.

Sensors are typically core/shell in their morphological structure. They can also be other shapes or multilayer films. A shell can be coated onto a core. Alternatively, a core/shell can be polymerized as a core/shell structure.

Sensors may be made by known means for producing multilayer coatings. These known methods include the methods described in the Kirk-Othmer Encyclopedia of Chemical Technology, $4^{th}$ Edition, New York: Wiley, 1993, volume 6, pages 606 to 669. Said pages are incorporated herein by reference. The core or intermediate layer of a sensor may exhibit luminescence, color change, change in acoustic reflectivity, electrical properties or other remotely detectible change in response to a specific triggering stimulus. The choice of which layer will be designed and formulated to respond to a given trigger is made depending on the application.

Depending on the application the outer layer can be a protective layer, reactive layer or shedding layer.

Sensors may be designed to be neutrally buoyant when distributed in a given fluid.

Sensors may comprise 1, 2, 3 or more layers wherein the core is considered to be a layer. The number of layers may depend upon the application.

Submarine Detection

Figure 2:
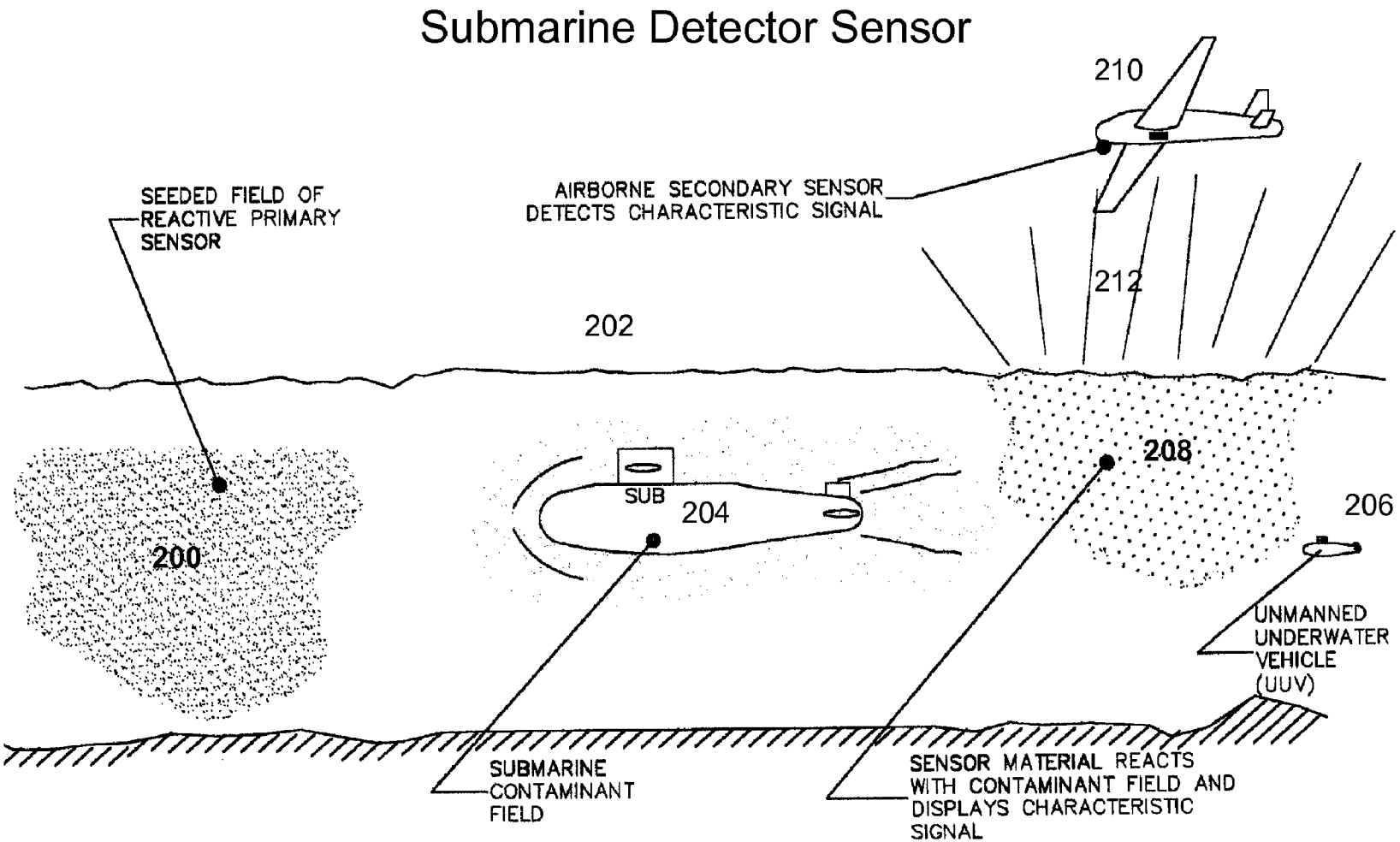
FIG. 2 illustrates the use of a field of sensors in submarine detection.

FIG. 2 illustrates a method of submarine 204 detection using the inventive sensors. A multiplicity of sensors 200 are seeded in a volume of water 202. Said water may be sea water. Said sensors may be seeded by an unmanned underwater vehicle 206.

The sensors comprise a core, an intermediate layer and an outer layer. The overall size and density of the sensors is chosen so that the sensors disperse themselves uniformly over a given range of depths in said volume of water. Selected densities in the range of 1.015 to 1.035 g/cc are suitable.

The outer layer of said sensors has a density greater than said water. The combined core and intermediate layer have a density less than the water they are distributed in.

The intermediate layer is designed such that it if said sensor is subject to the shear forces generated by a submarine wake or propulsion system, at least a portion of said outer layer spalls off of said intermediate layer. Said sensor would then float 208 to the surface of said volume of water.

Said intermediate layer is designed to be detectible by an aircraft 210 passing over said volume of water. For example, said intermediate layer may comprise a fluorescent dye. Said aircraft may interrogate said sensors on the surface of said volume of water with a laser and monitor for fluorescent emissions 212. Hence said submarine becomes detectible and trackable by said aircraft.

Table 1 presents a range of thicknesses of said layers that are suitable for submarine tracking. Column 1 identifies the layer. Column 2 shows the range of suitable thicknesses. Column 3 shows the activity of the layer.

TABLE 1

Sensor Layers for Submarine Detection and Tracking

| Layer | Thickness | Activity/Function |
|---|---|---|
| Overall sensor | 10 nm-5,000 μm | Detect and track submarine |
| Outer layer | 1 nm-3,000 μm | Sheds when subjected to shear forces |
| Intermediate layer | 1 nm-3,000 μm | Luminant or dye layer |
| Core | 1 nm-3,000 μm | Substrate |

A suitable overall diameter for said sensors is in the range of 10 nm (i.e. nanometer) to 5,000 μm (i.e. micron or micrometer). A preferred range is 0.5 μm to 3,000 μm.

Suitable thicknesses for the outer layer are in the range of 1 nm to 3,000 μm.

Suitable materials for the outer layer include biodegradable polylactic acid, and aliphatic polyesters or vinyls or olefinics or such polymers with reactive carboxyl, hydroxyl, or other water insensitive groups.

Suitable thicknesses for the intermediate layer are in the range of 1 nm to 3,000 μm.

Suitable materials for the intermediate layer include functional olefin homo- or copolymer, SEBS block copolymer (with functionality such as acrylic acid, hydroxyl or other equivalents), or low surface free energy polymers such as fluorinated polymers (e.g., fluoro-olefinics) and polysiloxanes and derivatives. The intermediate layer may also be physically modified such that it comprises polymer "brushes" to assist in the optimization of interfacial energy.

The materials and physical modifications and dimensions of the intermediate layer, outer layer and interfacial energy therebetween are chosen such that at least a portion of the outer layer will spall off of said intermediate layer when the sensor is exposed to shear forces or wake energy generated by a submarine.

The intermediate layer further comprises luminescent or dye material. Suitable luminescent materials include inorganic and organic luminescent materials. Suitable inorganic luminescent materials include rare earth metal sulfides, such as AVeda™ pigments provided by United Mineral & Chemical Corp (Lyndhurst, NJ). Suitable organic luminescent materials include Beaver Luminescent Pigments provided by Beaver Luminescers (Newton, Mass.).

IR luminescent dyes may be used when one wishes to detect a submarine while maintaining stealth. An IR laser would be used to interrogate sensors at the surface of said volume of water and an IR detector would be used to detect the luminescent emissions of any sensors that had floated to said surface.

Suitable thicknesses (diameter) for the core are in the range of 1 nm to 3,000 μm.

Suitable materials for the core include polylactic acid, biodegradable polyesters, and polyolefins (e.g., polyethylene, polypropylene).

The core may further comprise additives to reduce its density. Suitable additives include glass bubbles or hollow glass spheres. The glass spheres may have a diameter in the range of 1 to 500 microns. The density of the glass spheres may be in the range of 0.1 to 0.5 gm/cc. Suitable glass spheres include Scotchlite™ glass bubbles available from 3M company (St. Paul, Minn.).

Glass bubbles may also be added to the intermediate layer or outer layer to modify their respective densities.

The lower the density of the core, the faster the sensor will rise when the outer layer spalls off, depending upon the diameter of said sensor.

Density reducing agents may also be added to the intermediate layer.

The sensor may be designed such that at least a portion of both the intermediate layer and the outer layer spall off of the core when the sensor is subjected to shear forces. The luminant or dye material would then be in the core.

The outer layer and the intermediate layer may be a single layer. Similarly, the intermediate layer and the core may be a single layer. In each of these cases, the sensor would be a two-layer sensor.

EXAMPLE 1

In order to detect a submarine in a given volume of water, 50,000 detector particles are dispersed by an unmanned underwater vehicle over a one square mile area of the coastal zone. The sensors are 2,000 μm in diameter and have an average density of about 1.025 g/cc. The sensors are distributed uniformly over a depth of 1,000 feet from the surface.

The sensors have three layers.

The outer layer of the sensors is poly(lactic acid) with a thickness of 500 nm.

The intermediate layer of the sensors is polyethylene containing silicone slip additives and a conventional fluorescent dye.

The core is polyester of such diameter and density that the particle is initially neutrally buoyant at a given depth. Core polymer density is adjusted to a desired value by compounding the core polymer with glass beads.

When a submarine passes through the particle field, the submarine propeller wake energy causes the outer layer to be shed exposing the intermediate layer containing the ruminant. The sensor then floats to the surface where it is detected by an airplane using a conventional UV or IR detector.

EXAMPLE 2

100,000 sensors are dispersed by a helicopter over a two square mile area of the ocean down to a 1000 feet depth using a particle depth sowing device. The sensors are 1,000 μm in diameter and are distributed uniformly over the entire depth of 1,000 feet.

The outer layer of the sensors is polystyrene with a thickness suitable to give a particle its desired density.

The intermediate layer is polyethylene containing a wax additive. The thickness of the intermediate layer is 100 nm. The intermediate layer is designed such that both the intermediate layer and outer layer will shed when the sensor is subjected to the wake energy of a submarine.

The core is polyester mixed with a conventional fluorescent dye and sufficient glass beads to achieve proper density for initial neutral buoyancy at a given depth and positive buoyancy after shedding the intermediate layer and outer layer.

When a submarine passes through the sensor field, the intermediate layer is released from the core by the energetic action of the submarine wake. The core polyester particle then floats to the surface where it is detected by a drone using a conventional detector.

The sensors can be dispersed by aircraft, surface vessel, drone, or underwater vehicle. The sensors can be detected by standard external monitors in aircraft, drone, surface vessels, or under water vehicles. Additionally, the sensors should be of good physical integrity so that they can withstand the shear forces of distribution.

The size and density of the sensors may be selected so that they remain suspended over a range of depths for a suitable period of time, given the local currents. Persistence times of ½ hour to 48 hours are suitable for submarine tracking.

While particular embodiments of the present invention have been illustrated and described, it would be obvious to those skilled in the art that various other changes and modifications can be made without departing from the spirit and scope of the invention. Any of the aspects of the present invention found to offer advantages over the state of the art may be used separately or in any suitable combination to achieve some or all of the benefits of the invention disclosed herein.

We claim:

1. A sensor for detecting and responding to a triggering stimulus, said sensor comprising:

a) an outer layer;

b) an intermediate layer; and c) a core;

wherein said triggering stimulus causes a change in a detectible property of said sensor such that said change in said detectible property is detectible by an external monitor and wherein the interface between said outer layer and said intermediate layer is such that at least a portion of said outer layer separates from said intermediate layer when said sensor is exposed to the propeller wake energy of a submarine.

2. The sensor of claim 1 wherein said outer layer comprises a water resistant polymer.

3. The sensor of claim 2 wherein said water resistant polymer comprises one or more of a polyolefin, polyvinyl, styrenic, or vinyl.

4. The sensor of claim 1 wherein said outer layer has a thickness in the range of 1 nanometer to 3,000 μm.

5. The sensor of claim 1 wherein said sensor comprises a low surface energy polymer.

6. The sensor of claim 5 wherein said low surface energy polymer comprises one or more of a polyethylene or a polysiloxane.

7. The sensor of claim 5 wherein said sensor further comprises a silicone or a polyolefin.

8. The sensor of claim 1 wherein said outer layer has a thickness in the range of 1 nanometer to 3,000 μm.

9. The sensor of claim 1 wherein said sensor has a spherical shape, said core comprises one or more of a biodegradable polymer, commodity polymer, specialty polymer or engineering polymer; and wherein said core has a spherical shape with a diameter in the range of 1 nanometer to 3,000 μm.

10. The sensor of claim 1 wherein said intermediate layer comprises a luminescent or a dye material.

11. The sensor of claim 1 wherein said sensor has a spherical shape and wherein the density of said sensor is about that of either sea water or fresh water such that said sensor is neutrally buoyant at a depth of either sea water or fresh water, said depth being in the range of 0 to 1000 feet.

12. The sensor of claim 11 wherein the combination of said intermediate layer and said core of said sensor has a density less than that of either sea water or fresh water such that said sensor will float to the surface of sea water or fresh water if said outer layer is removed.

13. The sensor of claim 12 wherein said intermediate layer comprises a luminescent material such that said sensor is visible to a luminescence sensor mounted on an aircraft when said outer layer is removed from said sensor and said sensor is floating at or near the surface of either sea water or fresh water.

14. The sensor of claim 1 wherein a) said sensor has a spherical shape;

b) the interface between said outer layer and said intermediate layer is such that said outer layer separates from said intermediate layer when said sensor is exposed to the propeller wake energy of a submarine;

c) said intermediate layer comprises a luminant such that upon interrogation said luminant is detectible from an external monitor when said outer layer is removed from said sensor and said sensor is at the surface of sea water;

d) the density of said sensor is about the same as that of sea water;

e) the density of the combination of said intermediate layer and said core is less than that of sea water such that said combination will float to the surface of sea water when said outer layer is removed from said sensor.

15. A sensor for detecting a triggering stimulus, said sensor comprising an outer layer, an intermediate layer, and a core; wherein said triggering stimulus causes a change in a detectible property of said sensor such that said change in said detectible property is detectible by an external monitor; and wherein said sensor has a spherical shape, said core comprises one or more of a biodegradable polymer, commodity polymer, specialty polymer or engineering polymer, a luminant or a dye; and wherein said core has a spherical shape with a diameter in the range of 1 nanometer to 3,000 μm.

16. A sensor for detecting a triggering stimulus, said sensor comprising an outer layer, an intermediate layer, and a core; wherein said triggering stimulus causes a change in a detectible property of said sensor such that said change in said detectible property is detectible by an external monitor and wherein the interface between said intermediate layer and said core is such that at least a portion of said intermediate layer separates from said core when said sensor is exposed to the propeller wake energy of a submarine.

17. A sensor for detecting a triggering stimulus, said sensor comprising an outer layer, an intermediate layer, and a core; wherein said triggering stimulus causes a change in a detectible property of said sensor such that said change in said detectible property is detectible by an external monitor; and wherein said sensor has a spherical shape; and wherein the density of said sensor is about that of either sea water or fresh water such that said sensor is neutrally buoyant at a depth of either sea water or fresh water, said depth being in the range of 0 to 1000 feet.

* * * * *